US010013930B2

(12) United States Patent
Sakaigawa et al.

(10) Patent No.: US 10,013,930 B2
(45) Date of Patent: Jul. 3, 2018

(54) DISPLAY DEVICE AND METHOD OF DRIVING THE SAME

(71) Applicant: Japan Display Inc., Minato-ku (JP)

(72) Inventors: Akira Sakaigawa, Tokyo (JP); Yoichi Asakawa, Tokyo (JP); Shinichiro Oka, Tokyo (JP)

(73) Assignee: Japan Display Inc., Minato-ku (JP)

( * ) Notice: Subject to any disclaimer, the term of this patent is extended or adjusted under 35 U.S.C. 154(b) by 284 days.

(21) Appl. No.: 14/959,406

(22) Filed: Dec. 4, 2015

(65) Prior Publication Data

US 2016/0163273 A1 Jun. 9, 2016

(30) Foreign Application Priority Data

Dec. 8, 2014 (JP) ..... 2014-247904
Nov. 12, 2015 (JP) ..... 2015-222143

(51) Int. Cl.
*G09G 3/36* (2006.01)
*G09G 3/34* (2006.01)

(52) U.S. Cl.
CPC ..... *G09G 3/3607* (2013.01); *G09G 3/3413* (2013.01); *G09G 2300/0452* (2013.01); *G09G 2310/0235* (2013.01); *G09G 2320/0666* (2013.01)

(58) Field of Classification Search
CPC ..... G09G 3/3607; G09G 3/3413; G09G 2300/0452; G09G 2320/0666; G09G 2310/0235
See application file for complete search history.

(56) References Cited

U.S. PATENT DOCUMENTS 4,966,441 A * 10/1990 Conner ..... G06F 1/203 349/6
2004/0239839 A1* 12/2004 Hong ..... G02F 1/133514 349/106
2006/0050209 A1 3/2006 Higa
(Continued)

FOREIGN PATENT DOCUMENTS

JP 2005-234133 9/2005
JP 2005-258248 9/2005
(Continued)

OTHER PUBLICATIONS

Office Action dated Nov. 30, 2016 in Korean Patent Application No. 10-2015-0170667 (with English language translation).
(Continued)

*Primary Examiner* — Mihir K Rayan
(74) *Attorney, Agent, or Firm* — Oblon, McClelland, Maier & Neustadt, L.L.P.

(57) ABSTRACT

According to one embodiment, the power consumption can be reduced as a whole without a large decrease in the efficiency of transmittance. According to one embodiment, a display device includes subpixels arranged in a first direction and a second direction Y intersecting the first direction, color filters corresponding to the subpixels, respectively, and a light device. The color filters include at least blue filters and yellow filters adjacent to each other. A frame period of the light device includes at least a period of outputting cyan light and a period of outputting magenta light.

16 Claims, 16 Drawing Sheets

(56) References Cited

U.S. PATENT DOCUMENTS

2006/0098033 A1* 5/2006 Langendijk ..... G02B 5/201 345/694
2006/0267892 A1* 11/2006 Pei ..... G09G 3/3685 345/88
2007/0091045 A1* 4/2007 Hisatake ..... G09G 3/3607 345/88
2007/0139352 A1* 6/2007 Pugh ..... G02F 1/133514 345/102
2007/0182682 A1* 8/2007 Hong ..... G09G 3/3413 345/88
2007/0268429 A1* 11/2007 So ..... G02F 1/133603 349/106
2007/0296666 A1* 12/2007 Son ..... G09G 3/3607 345/88
2010/0020007 A1 1/2010 You et al.
2010/0188322 A1* 7/2010 Furukawa ..... G02F 1/133514 345/83
2011/0043486 A1 2/2011 Hagiwara et al.

FOREIGN PATENT DOCUMENTS

JP 2007-513360 A 5/2007
JP 2008-96549 A 4/2008
JP 2010-32626 2/2010
KR 10-2004-0103997 A 12/2004
KR 10-2010-0087254 A 8/2010
KR 10-2011-0108147 A 10/2011
TW 201007686 A1 2/2010

OTHER PUBLICATIONS

Combined Taiwanese Office Action and Search Report dated Jan. 10, 2017 in Patent Application No. 104139232 (with English translation).

* cited by examiner

| | Embodiment 1 | | Conventional FSC system |
|---|---|---|---|
| | Yellow (Y) | Blue (B) | |
| | Y | B | No filter |
| Aperture ratio | 67.0% | 57.8% | 78.8% |
| Transmittance | 13.0% | 0.34% | 25.3% |

| | RGB LED | Phosphor (Phos) LED |
|---|---|---|
| Luminance | 1.7cd | 2.7cd |
| Current | 30mA | 20mA |
| LED effect | 100 | 251 |
| LED effect (incl. duty loss) | 90 | 226 |

FIG. 7A

| | | Aperture ratio | Transmittance a | LED effect b | Power efficiency of light device a × b |
|---|---|---|---|---|---|
| Conventional FSC system | | 78.8% | 25.3% | 90 | 22.8 |
| Embodiment | B:Y=1:2 | B:57.8%<br>Y:67.8% | 13.3% | 226 | 30.1 |
| | B:Y=1:3 | B:49.9%<br>Y:73.0% | 16.1% | 226 | 36.4 |

FIG. 7B

DISPLAY DEVICE AND METHOD OF DRIVING THE SAME

CROSS-REFERENCE TO RELATED APPLICATIONS

This application is based upon and claims the benefit of priority from Japanese Patent Applications No. 2014-247904, filed Dec. 8, 2014; and No. 2015-222143, filed Nov. 12, 2015, the entire contents of all of which are incorporated herein by reference.

FIELD

Embodiments described herein relate generally to a display device and a method of driving the same.

BACKGROUND

Recently, portable devices including smartphones, personal digital assistants (PDAs), tablet computers and the like have become widespread. Such portable devices are increasing in display performance and can display color images.

A field-sequential color (FSC) system is one of techniques for displaying color images. In the FSC system, a red (R) light-emitting device, a green (G) light-emitting device and a blue (B) light-emitting device are conventionally used as a light device. In the FSC system, a frame period is separated into three periods (also called three fields), i.e., a light-emitting period of the red (R) light-emitting device, a light-emitting period of the green (G) light-emitting device and a light-emitting period of the blue (B) light-emitting device. Pixels selected for red display (selected R pixels), pixels selected for blue display (selected B pixels) and pixels selected for green display (selected G pixels) are driven in three (R, G, B) fields, respectively. As a light-emitting device, a point source can also be used. More specifically, a light-emitting diode (LED) can be used as the point source.

The selected R, B and G pixels are pixels corresponding to R, G and B signals and selected from pixels two-dimensionally arrayed on a liquid crystal display panel. A display image of the selected R pixels, a display image of the selected B pixels and a display image of the selected G pixels are separately displayed on the liquid crystal display in sequence, but the user can see a color image by persistence of vision. The FSC system is excellent in utilization of light because no color filter is necessary for the liquid crystal display panel.

BRIEF DESCRIPTION OF THE DRAWINGS

FIG. 7A is a table showing a relationship between a luminance of R, G and B LEDs and a current, and a result of multiplying a luminance of a phosphor LED (white [W] LED applied with a phosphor) and a current as an LED effect in the case where a result of multiplying the luminance of the R, G and B LEDs and the current is defined as 100.

FIG. 7B is a comparative table showing an aperture ratio, a transmittance and an LED effect of a conventional field sequence system and those of the embodiment.

DETAILED DESCRIPTION

Figure 1:
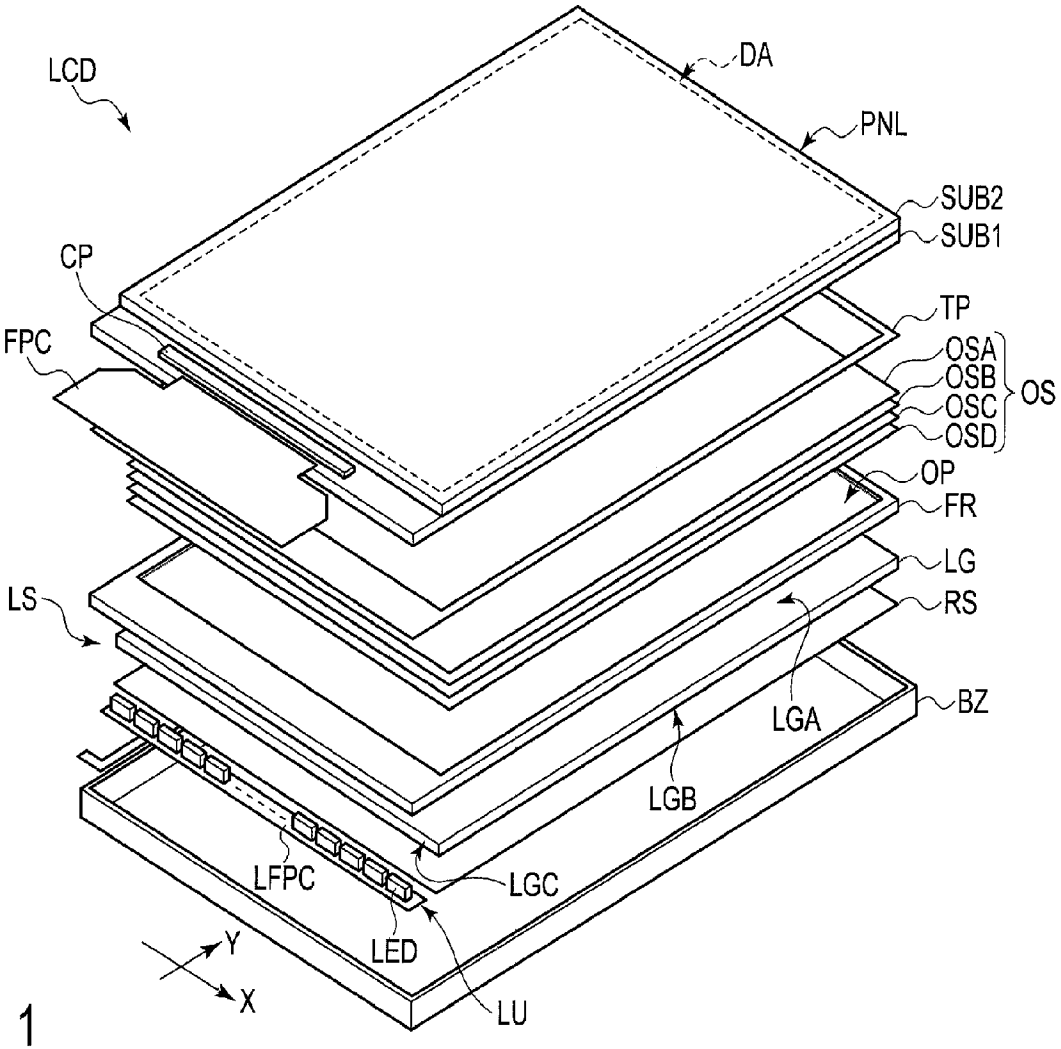
FIG. 1 is an exploded perspective view schematically showing a structural example of a liquid crystal display LCD of an embodiment.

Various embodiments will be described hereinafter with reference to the accompany drawings.

First, an introduction of embodiments to be described below is provided. The FSC system is excellent in utilization of light because no color filter is necessary for the liquid crystal display panel. However, the luminance efficiency of a green (G) LED is about a third of the luminance efficiency of a blue (B) LED. There is a problem that a large amount of energy is consumed if supplied power is increased to improve the luminance efficiency of the green (G) LED. A wavelength of a red (R) LED related to chromaticity has a property of easily changing with time. In order to maintain a white region in a chromaticity diagram, chromaticity of the green (G) and blue (B) LEDs should be adjusted along with the change of chromaticity of the red (R) LED. However, the adjustment is technically difficult.

There is also a problem that a color breakup (CBU) easily occurs and image quality is degraded. For example, when a plate having a stripe window is put on a display surface of a liquid crystal display panel displaying R, G and B color stripes by the field-sequential system and the plate is swung in a direction intersecting the stripes, a phenomenon where narrow color stripes are seen on the screen through the window of the plate occurs, which is called CBU. In such a case, the display surface should preferably appear white. Another example of CBU is that, when black and white stripes are displayed by the field-sequential system and the user quickly turns his eyes, edges of the stripes appear colored.

In order to reduce such CBU, it is effective to include a white (W) field in a frame period in addition to three fields (also called three subframes) of RGB, i.e., include four fields in total. In this manner, however, since a frame is separated into four fields, the field frequency of a driving circuit of LEDs should be increased from triple to quadruple the frame frequency. As a result, the energy consumption is increased.

To solve the problem, the present embodiment aims to provide a display device capable of reducing the energy consumption as a whole without a large decrease in the efficiency of transmittance and a method of controlling the display device.

The embodiment is hereinafter specifically described. According to the embodiment, a display device comprises: subpixels arranged in a first direction and a second direction intersecting the first direction; color filters corresponding to the subpixels, respectively; and a light device. The color filters include at least blue filters and yellow filters adjacent to each other. The light device comprises a light source and a frame period of the light source includes at least a period of outputting cyan light and a period of outputting magenta light.

The disclosure is merely an example. Arbitrary changes easily conceivable by a person of ordinary skill in the art without departing from the spirit of the invention are deservingly included in the scope of the present invention. In the drawings, the width, thickness, shape and the like of each element are often shown schematically in comparison with the actual state to clarify descriptions, but these do not limit interpretation of the invention. In the specification and the drawings, a constituent element that performs a function equivalent or similar to that of the constituent element already described with reference to the preceding drawing is often represented by the same reference number and the overlapping detailed description is omitted as appropriate.

FIG. 1 is an exploded perspective view schematically showing a structural example of a liquid crystal display LCD of an embodiment. The liquid crystal display LCD comprises an active matrix liquid crystal display panel PNL, a double-sided tape TP, optical sheets OS, a frame FR, a lightguide plate LG, a light source unit LU, a reflective sheet RS, a bezel BZ and the like. A surface light source device LS is a light device which allows light to enter the liquid crystal display panel PNL. The surface light source device LS comprises at least the lightguide plate LG and the light source unit LU.

The liquid crystal display panel PNL comprises a plane first substrate SUB1, a plane second substrate SUB2 opposed to the first substrate SUB1, and a liquid crystal layer sandwiched between the first substrate SUB1 and the second substrate SUB2. Since the liquid crystal layer is extremely thinner than the liquid crystal display panel PNL and is positioned inside a seal material bonding the first substrate SUB1 and the second substrate SUB2, the liquid crystal layer is not shown in the drawings.

The liquid crystal display panel PNL has a display area DA in which an image is displayed. The display area DA corresponded to a part of an area in which the first substrate SUB1 is opposed to the second substrate SUB2. In the example of FIG. 1, the display area DA is rectangular. The display area DA is also called an active area. The liquid crystal display panel PNL is a transmissive liquid crystal display panel having a function of displaying images by selectively allowing light from the surface light source device LS to pass there through. With respect to a display mode, the liquid crystal display panel PNL may have a structure corresponding to a lateral electric field mode mainly using a lateral electric field substantially parallel to the substrate principal surface or a structure corresponding to a longitudinal electric field mode mainly using a longitudinal electric field substantially vertical to the substrate principal surface.

In the example of FIG. 1, a driving IC chip CP and a flexible printed circuit board FPC are mounted on the first substrate SUB1 as a signal source which supplies a signal necessary for driving the liquid crystal display panel PNL.

The optical sheets OS have a light transmitting property, are positioned at the back of the liquid crystal display panel PNL and are opposed to at least the display area DA. The optical sheets OS include a diffusion sheet OSA, a prism sheet OSB, a prism sheet OSC, a diffusion sheet OSD and the like. In the example of FIG. 1, the optical sheets OS are rectangular. FIG. 1 indicates an example of the number of diffusion sheets and prism sheets included in the optical sheet OS, and, the configuration of the laminate. The present embodiment is not limited to the example shown in FIG. 1.

The frame FR is positioned between the liquid crystal display panel PNL and the bezel BZ. In the example of FIG. 1, the frame FR has a rectangular frame shape and comprises a rectangular opening OP opposed to the display area DA. FIG. 1 indicates an example of the shape of the frame FR. The present embodiment is not limited to the example shown in FIG. 1. Also, if there is no need frame FR may be omitted.

The double-sided tape TP is positioned between the liquid crystal display panel PNL and the frame FR outside the display area DA. For example, the double-sided tape TP has a light blocking effect and has a rectangular frame shape. The display panel PNL and the frame FR is, if it is possible to be fixed without using the double-sided tape TP, may not be provided a double-sided tape TP.

The lightguide plate LG is positioned between the frame FR and the bezel BZ. The lightguide plate LG has a flat panel shape and includes a first principal surface LGA, a second principal surface LGB on the opposite side of the first principal surface LGA and a side surface LGC connecting the first principal surface LGA and the second principal surface LGB.

The light source unit LU is located along the side surface LGC of the lightguide plate LG. The light source unit LU comprises light-emitting diodes LED, a flexible printed circuit board LFPC on which the light-emitting diodes LED are mounted, and the like. In the example of FIG. 1, the light-emitting diodes LED are aligned along the side surface LGC parallel to the short side of the lightguide plate LG. The light-emitting diodes LED may be aligned along another side surface parallel to the long side of the lightguide plate LG (i.e., a side surface intersecting the side surface LGC). In other words, the light-emitting diodes LED are aligned in a first direction X in FIG. 1 but may be aligned in a second direction Y intersecting the first direction X. The light-emitting diodes LED are driven by a field-sequential system as described later.

The reflective sheet RS has light reflectivity and is positioned between the bezel BZ and the lightguide plate LG. In the example of FIG. 1, the reflective sheet RS is rectangular.

The bezel BZ accommodates the liquid crystal display panel PNL, the double-sided tape TP, the optical sheets OS, the frame FR, the lightguide plate LG, the light source unit LU and the reflective sheet RS. In the example of FIG. 1, the surface light source device LS is opposed to the back surface of the liquid crystal display panel PNL, i.e., the first substrate SUB1, and functions as a light device (in this case, a backlight).

Figure 2:
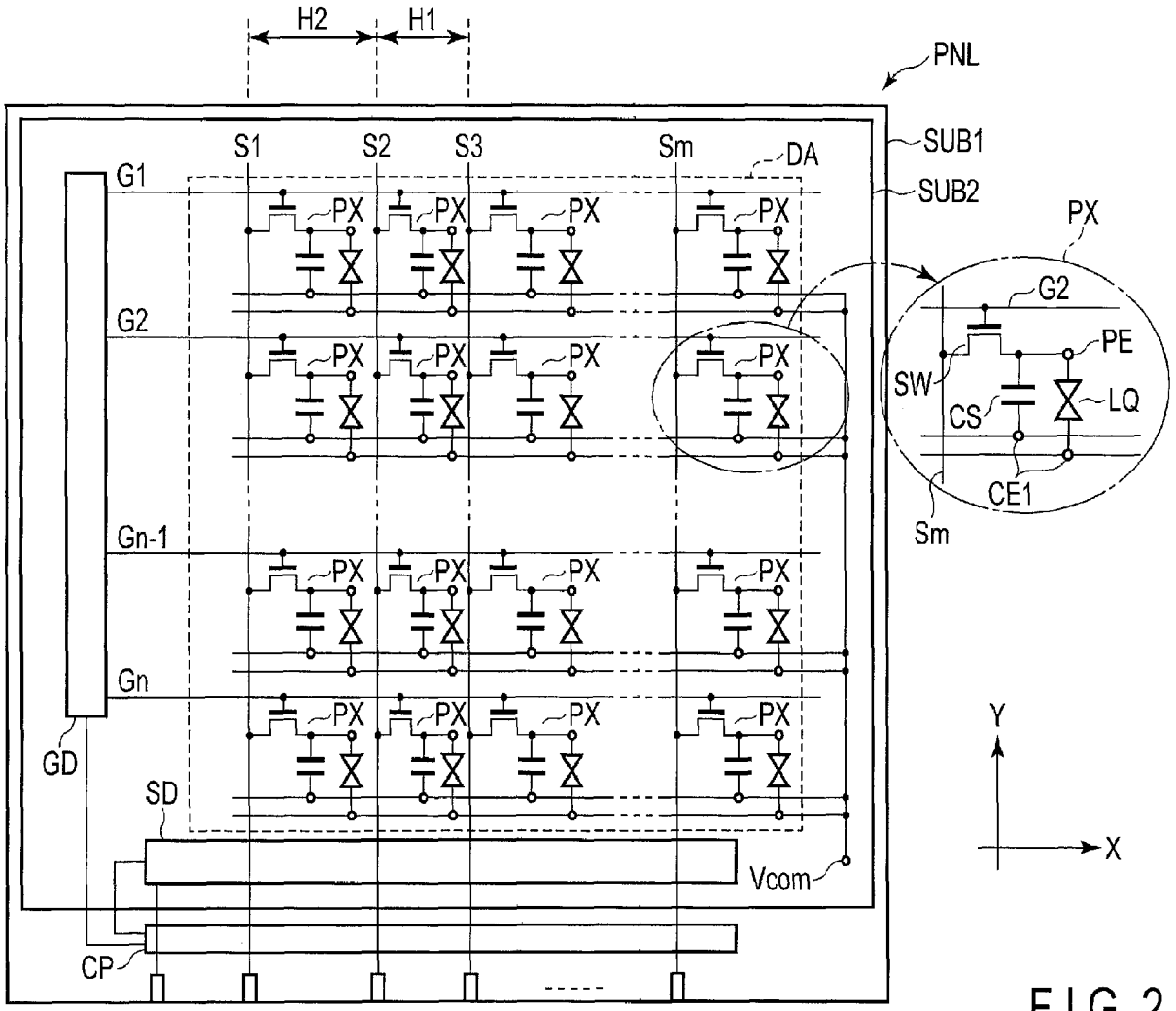
FIG. 2 is a diagram schematically showing a structure and equivalent circuits of a liquid crystal display panel PNL.

FIG. 2 is a diagram schematically showing an example of a structure and equivalent circuits of the liquid crystal display panel PNL. The display device comprises the active matrix liquid crystal display panel PNL. The liquid crystal display panel PNL comprises the first substrate SUB1, the second substrate SUB2 opposed to the first substrate SUB1 and the liquid crystal layer LQ sandwiched between the first substrate SUB1 and the second substrate SUB2. The display area DA corresponds to an area in which the liquid crystal layer LQ is sandwiched between the first substrate SUB1 and the second substrate SUB2. The display area DA is, for example, quadrangular, and includes subpixels arrayed in a matrix. The subpixels are positioned near intersections of gate lines extending in the first direction X and source lines extending in the second direction Y. A driving circuit which selectively supplies each subpixel with a pixel signal is provided.

In the specification, a subpixel has a structure into which a pixel circuit and a color filter are integrated. Therefore, a subpixel comprises a single color filter and expresses a single color. In contrast to a subpixel, a minimum unit of subpixels comprising different color filters capable of expressing various colors from primary colors to neutral colors is called a pixel or a combined pixel. As a combination of subpixels, for example, a combination of subpixels comprising red, green and blue filters, a combination of subpixels comprising yellow and blue filters, a combination of subpixels comprising yellow, blue and white filters and the like can be used as described later.

In the display area DA, the first substrate SUB1 comprises gate lines G (G1 to Gn) extending in the first direction X (also called a row direction or a lateral direction) and source lines S (S1 to Sm) extending in the second direction Y (also called a column direction or a vertical direction) intersecting the first direction X.

As shown in an enlarged view on the right side of FIG. 2 (area surrounded by a one-dot chain line) as representative, each subpixel comprises a switching element SW electrically connected to the gate line G and the source line S, a pixel electrode PE electrically connected to the switching element SW in the subpixel, common electrodes CE1 opposed to the pixel electrode PE and the like. Two common electrodes CE1 are shown in FIG. 2, but they are actually integrated. For example, storage capacitance CS is formed between the common electrode CE1 and the pixel electrode PE. The second substrate SUB2 is opposed to the first substrate SUB1 with the liquid crystal layer LQ between. The storage capacitance CS may be provided or omitted as appropriate. For example, when the liquid crystal display LCD is a fringe-field switching (FFS) mode, it is unnecessary to provide the storage capacitance CS since the pixel electrode PE, the common electrode CE1 and an insulator positioned between them function as the storage capacitance CS.

Each gate line G (G1 to Gn) is extracted outside the display area DA and connected to a first driving circuit GD. Each source line S (S1 to Sm) is extracted outside the display area DA and connected to a second driving circuit SD. For example, at least a part of the first driving circuit GD and the second driving circuit SD is formed on the first substrate SUB1 and connected to the driving IC chip (also called a liquid crystal display driver or a drive circuit controller) CP.

The second driving circuit SD can output pixel signals of different polarities when outputting pixel signals to adjacent source lines in order to implement a column inversion driving method. The driving IC chip CP is equipped with a controller which controls the first driving circuit GD and the second driving circuit SD, and functions as a signal source which supplies a signal necessary for driving the liquid crystal display panel PNL. In the example of FIG. 2, the driving IC chip CP is mounted on the first substrate SUB1 outside the display area DA of the liquid crystal display panel PNL.

The common electrodes CE1 extend across the whole display area DA and are formed to be common to subpixels. Each common electrode CE1 is extracted outside the display area DA and connected to a power supply module Vcom. For example, the power supply module Vcom is formed on the first substrate SUB1 outside the display area DA and electrically connected to the common electrodes CE1. The power supply module Vcom is supplied with a constant common voltage.

Color filters are arranged with regularity in the subpixels. The color filters are formed on the second substrate SUB2 to be opposed to the pixel electrodes with the liquid crystal layer LQ between.

For example, the subpixels form the first column, the second column, the third column, . . . , a color filter of the first column is blue (B), a color filter of the second column is yellow (Y), and these colors are repeated in the first direction X. Width H2 of the yellow filter is greater than width H1 of the blue filter.

Figure 3A:
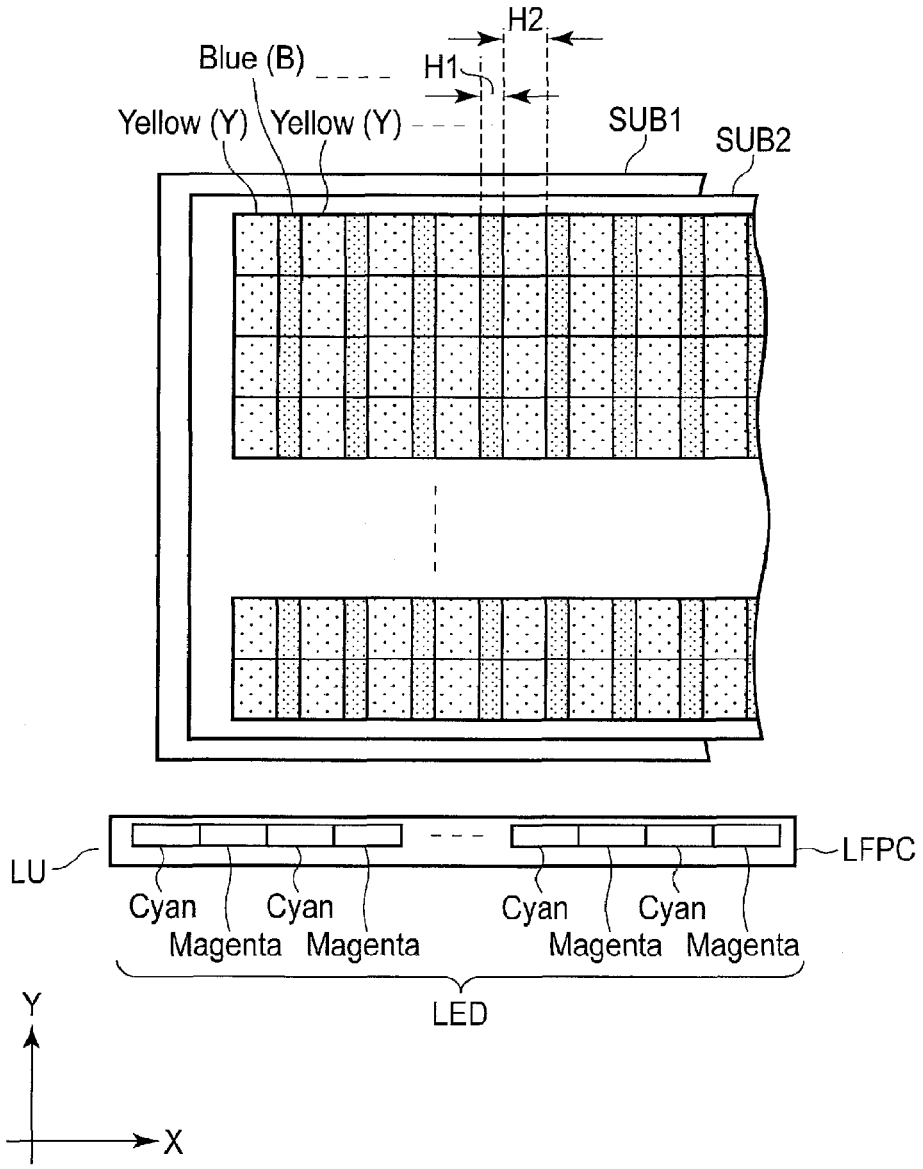
FIG. 3A is a diagram showing an example of a layout of color filters of subpixels and colors of a light device.

FIG. 3A shows an example of a layout of color filters of subpixels and colors of the light device. In FIG. 3A, elements on the first substrate SUB1 such as the source lines S (S1 to Sm) are omitted to simplify the layout of the color filters.

Blue filters (width H1) and yellow filters (width H2) are alternately arranged in the first direction X (lateral direction of FIG. 3A). The color filters are formed on the second substrate SUB2. The surface light source device, i.e., the light device of the display device is driven by the field-sequential system. Light-emitting diodes LED of the light device include light-emitting diodes emitting cyan light and light-emitting diodes emitting magenta light. The light-emitting diodes LED are mounted on the flexible printed circuit board LFPC.

The cyan light-emitting diode can be implemented by, for example, covering a blue light-emitting diode with a green phosphor. The magenta light-emitting diode can be implemented by, for example, covering a blue light-emitting diode with a red phosphor. For example, the cyan light-emitting diodes are on (illuminating) in the first half of a frame and off (not illuminating) in the second half of a frame. In contrast, the magenta light-emitting diodes are driven to be off (not illuminating) in the first half of a frame and on (illuminating) in the second half of a frame.

The light-emitting diodes LED are aligned parallel to the short side of the lightguide plate. Light emitted from the light-emitting diodes LED enters the lightguide plate. The surface emission from the lightguide plate (i.e., periodically-repeated cyan and magenta light) thereby passes through subpixels in a light transmissive state. Since the drive system is the field-sequential system, the surface emission is the periodically-repeated cyan and magenta light.

Figure 3B:
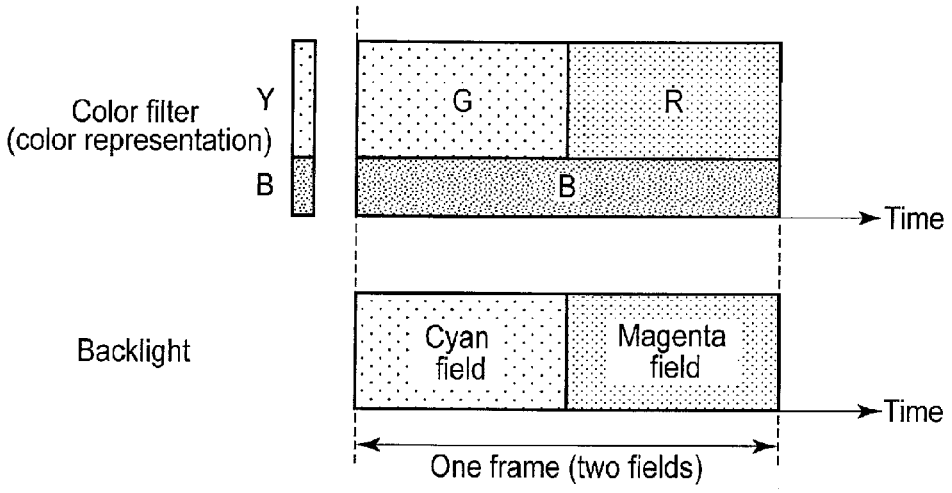
FIG. 3B is a diagram showing a relationship of colors output from color filters to a cyan field and a magenta field in a frame period of the light device.

FIG. 3B shows a relationship between fields of cyan and magenta light emitted from the light device and colors output from the color filters. A frame period of the light device includes a cyan field (½ frame) and a magenta field (½ frame). In the cyan field (½ frame), blue (B) and green (G) can be displayed on the display surface of the display device. In the magenta field (½ frame), blue (B) and red (R) can be displayed on the display surface of the display device.

As shown in FIG. 3B, blue (B) can be displayed in both the cyan and magenta fields. In contrast, green (G) can be displayed only in the cyan field and red (R) can be displayed only in the magenta field. As a result of this, the output level (emission intensity) of blue (B) tends to be greater than those of green (G) and red (R).

Figure 3C:
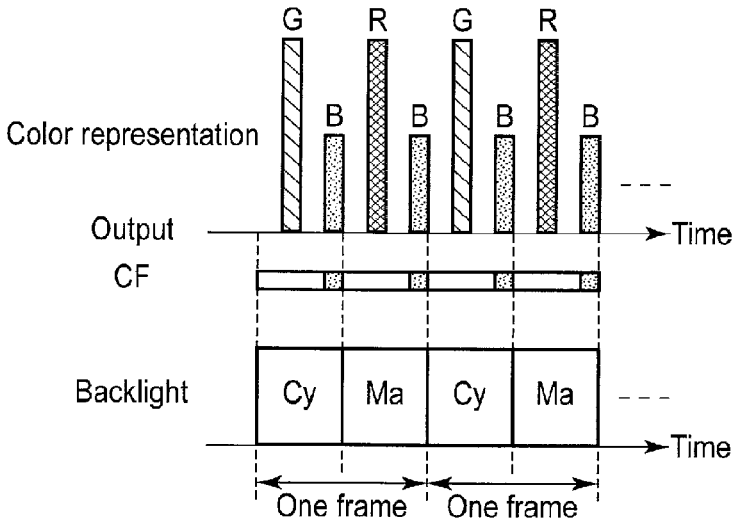
FIG. 3C is a graph showing an example of intensities of colors output from the color filters in cyan fields and magenta fields of the light device.

In order to redress such an imbalance, the device of the present embodiment is configured to obtain the balanced emission intensity of blue (B), green (G) and red (R) light as shown in, for example, FIG. 3A and FIG. 3C.

That is, width H1 of the blue filter is less than width H2 of the yellow filter such that the area of the blue filter is less than the area of the yellow filter. The emission intensities of blue (B), green (G) and red (R) light are thereby equal to each other in a frame period as shown in FIG. 3C.

It should be noted that the emission intensities of blue (B), green (G) and red (R) light required for obtaining the white balance are not necessarily equal to each other. In order to obtain a position of white in a chromaticity diagram, the emission intensities of blue (B), green (G) and red (R) light should preferably be set in consideration of characteristics (transmittance, etc.) of each color filter.

A frame includes two fields, i.e., a cyan field and a magenta field in the above embodiment, but is not limited to this.

Figure 4A:
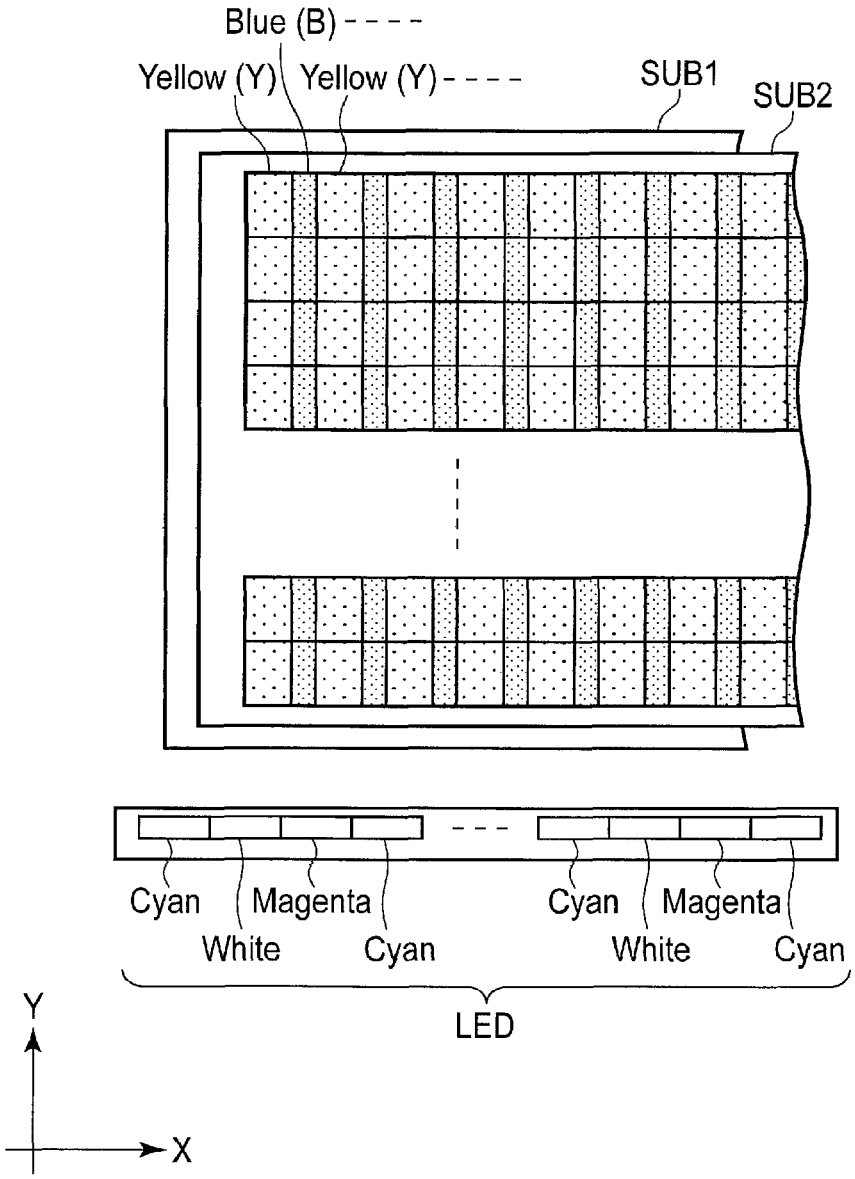
FIG. 4A is a diagram showing another example of a layout of color filters of subpixels and colors of the light device.
Figure 4B:
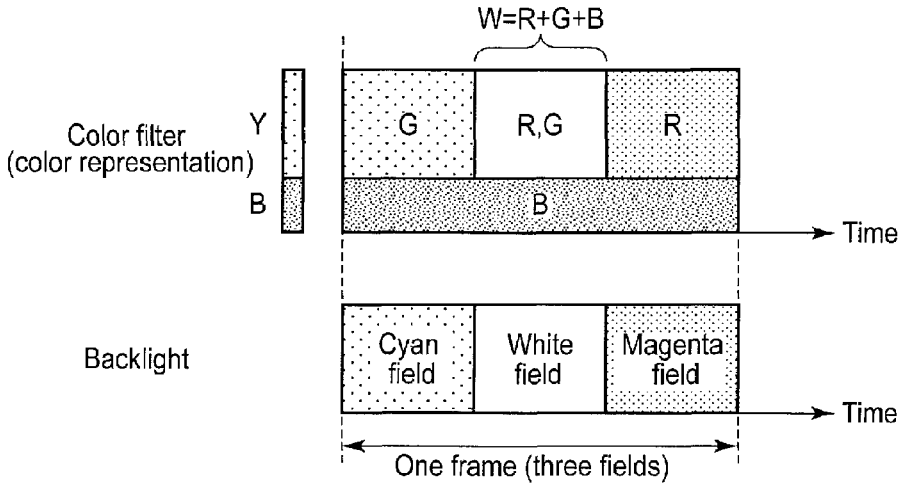
FIG. 4B is a diagram showing a relationship of colors output from color filters to a cyan field, a white field and a magenta field in a frame period of the light device.
Figure 4C:
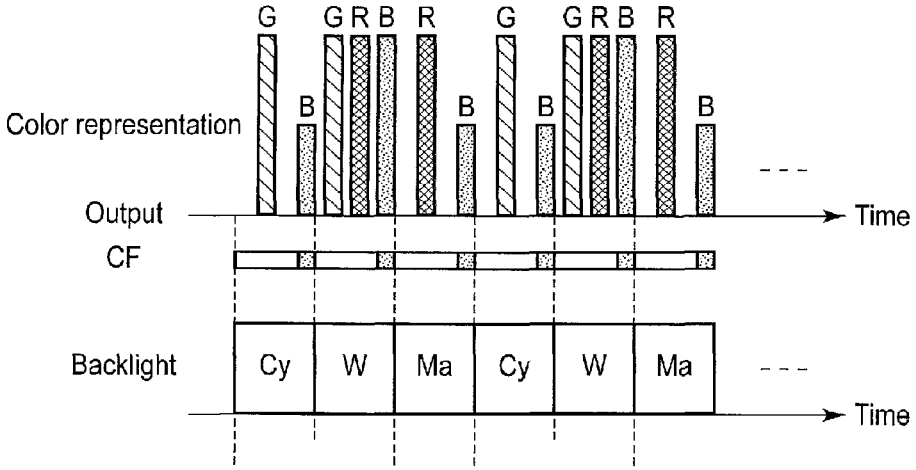
FIG. 4C is a graph showing an example of intensities of colors output from the color filters in cyan fields, white fields and magenta fields of the light device.

FIG. 4A, FIG. 4B and FIG. 4C show an embodiment in which a frame includes three fields, i.e., a cyan field, a magenta field and a white field. Therefore, light-emitting diodes LED including the light device include cyan light-emitting diodes, white light-emitting diodes and magenta light-emitting diodes, as shown in FIG. 4A.

Figure 9A:
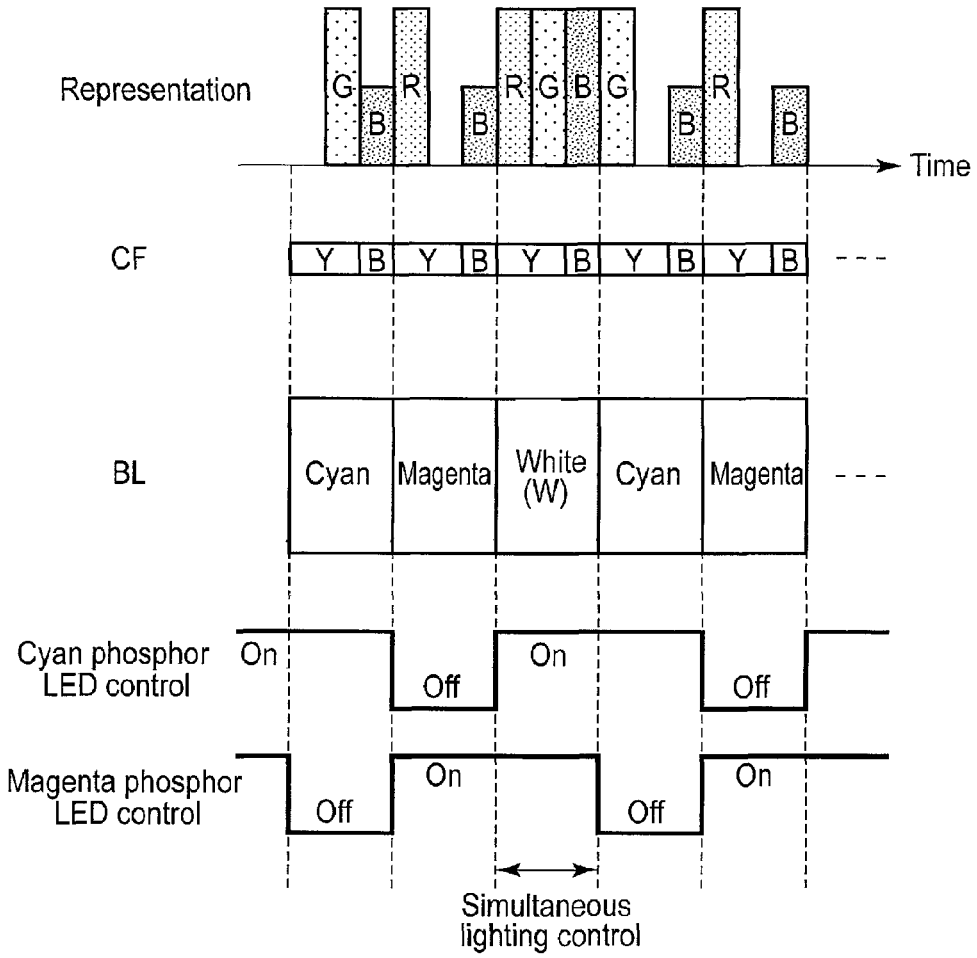
FIG. 9A is a timing chart showing operation of a light device of another embodiment which has a white (W) emission field in addition to cyan and magenta emission fields.
Figure 9B:
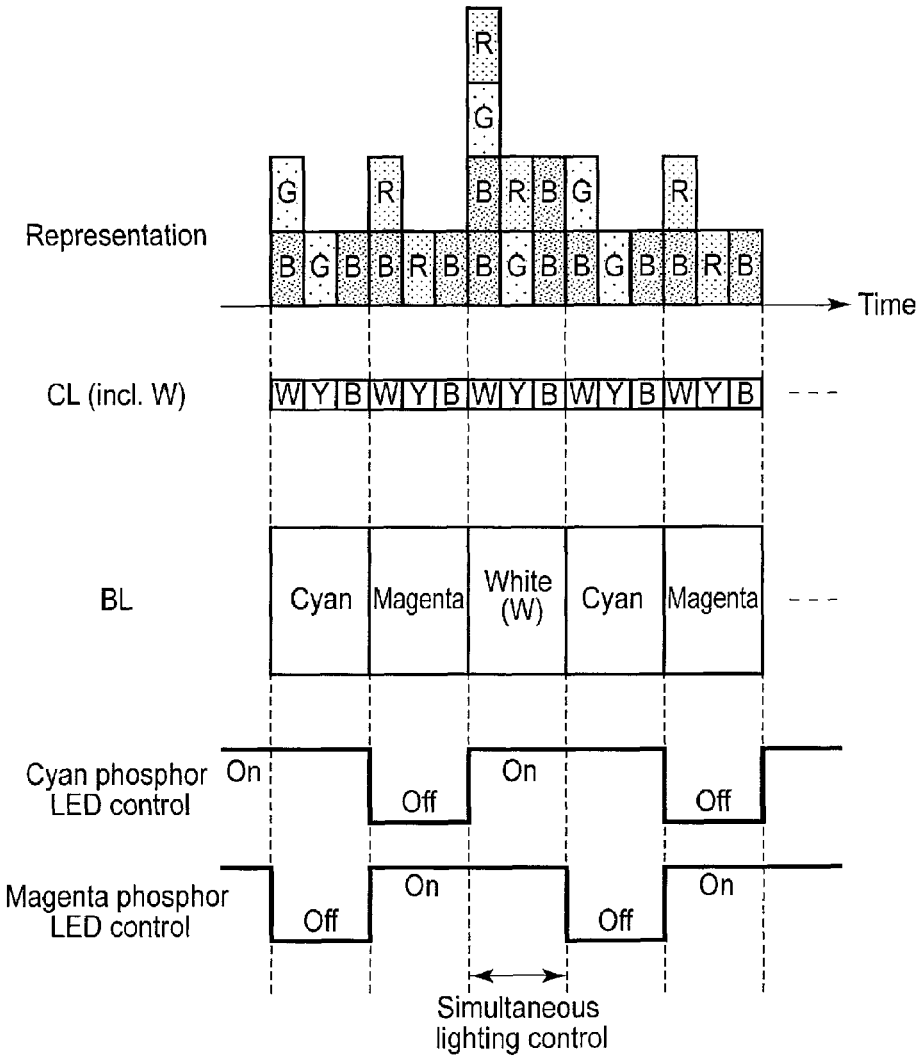
FIG. 9B is a timing chart showing operation of a light device of yet another embodiment which has a white (W) emission field in addition to cyan and magenta emission fields and further has a white (W) filter in addition to yellow and blue filters.

The light source unit LU with light-emitting diodes LED shown in FIG. 3A and FIG. 4A is positioned on the side of the end face of the lightguide plate in the second direction Y. However, the position of the light source unit LU is not limited to this. The light source unit LU may be positioned on the side of the end face of the lightguide plate in the first direction X. The light source unit LU shown in FIG. 4A can provide cyan, white and magenta fields. FIG. 4A shows white light-emitting diodes, but the light source unit LU does not necessarily comprise the white light-emitting diodes. This is because a white field can be provided by turning on cyan and magenta light-emitting diodes at the same time as shown in FIG. 9A and FIG. 9B, which is described later.

FIG. 4B is a sequence diagram in which a frame period is separated into a cyan field, a white field and a magenta field, and shows a relationship between the fields of cyan, white and magenta light emitted from the light device and colors of light output from the color filters. A frame period of the light device includes a cyan field (⅓ frame), a white field (⅓ frame) and a magenta field (⅓ frame). In the cyan field (⅓ frame), blue (B) and green (G) can be displayed on the display surface of the display device. In the white field (⅓ frame), blue (B), green (G) and red (R) can be displayed on the display surface of the display device, and accordingly white (W) can be displayed. In the magenta field (⅓ frame), blue (B) and red (R) can be displayed on the display surface of the display device.

FIG. 4C shows a situation where a frame period shown in FIG. 3C further includes a white (W=R, G, B) emission field in addition to cyan and magenta fields. In the present embodiment, a frame is separated into three fields. Therefore, the switching frequency of the light device is increased in comparison with the above-described embodiment in which a frame is separated into two fields. In comparison with a conventional device having a W field, however, a frame of the device of the present embodiment is one field less than a frame of the conventional device including four fields, i.e., R, G, B and W fields. Therefore, the energy consumption of the present embodiment is not greater than that of the conventional device even if a W field is added.

Figures 5, 6:
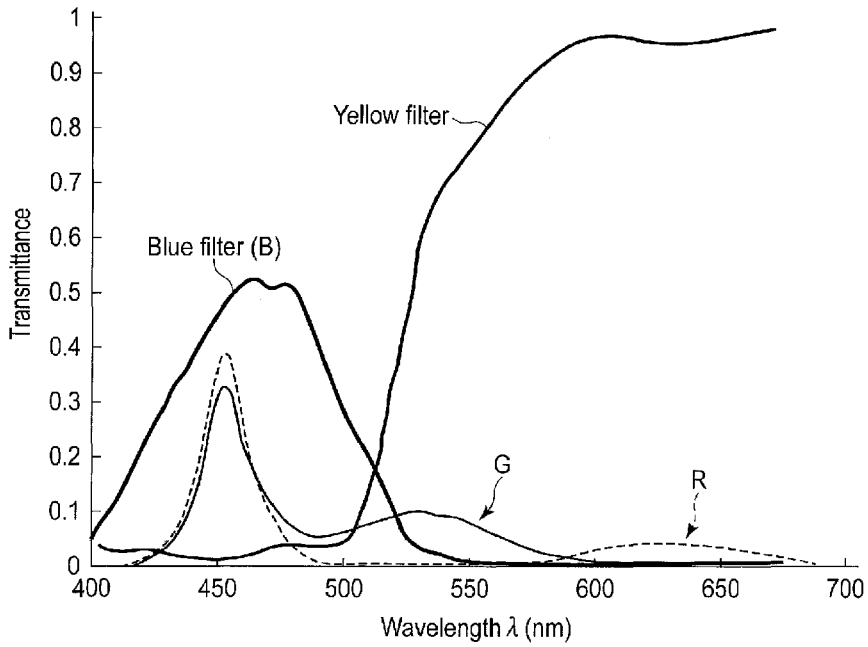
FIG. 5 is a graph showing transmittances of a blue filter and a yellow filter and emission energies of a blue (B) LED, a green (G) phosphor and a red (R) phosphor.
FIG. 6 is a comparative table of aperture ratios and transmittances of a subpixel with a yellow filter and a subpixel with a blue filter and those of a subpixel with no filter.

FIG. 5 shows transmittances of blue and yellow filters according to wavelength and characteristic curves of emission energies of a blue (B) LED and green (G) and red (R) phosphors according to wavelength. A characteristic curve of the transmittance of the blue filter substantially corresponds to the characteristic curve of the emission energy of the blue (B) LED. According to the characteristic curve of the emission energy of the green (G) phosphor, green light with wavelengths of about 540 to 550 nm passes through the yellow filter. According to the characteristic curve of the emission energy of the red (R) phosphor, red light with wavelengths of about 630 to 650 nm passes through the yellow filter.

FIG. 6 is a comparative table of aperture ratios and transmittances of a subpixel with a yellow filter and a subpixel with a blue filter, and those of a subpixel with no filter. A subpixel with no filter has the aperture ratio of 78.8% and the transmittance of 25.3%. In contrast, a subpixel with a yellow filter has the aperture ratio of 67.0% and the transmittance of 13.0%, and a subpixel with a blue filter has the aperture ratio of 57.8% and the transmittance of 0.34%.

FIG. 7A shows factors to be referred to determine an LED effect. FIG. 7A shows a luminance (1.7 candelas) of each of red (R), green (G) and blue (B) LEDs and a current (30 mA). These values mean that each LED requires a current of 30 mA to emit light of 1.7 candelas. The LED effect is determined based on these values. That is, the LED effect is a level of luminance with respect to a current. For example, the LED effect is {(1.7)/30}=0.056, and this LED effect 0.056 is defined as 100.

FIG. 7A also shows a luminance (2.7 candelas) of a phosphor LED (element obtained by covering an LED of a predetermined color with a phosphor so as to output cyan or magenta light) and a current (20 mA). These values mean that the phosphor LED requires a current of 20 mA to emit light of 2.7 candelas. Using these values, the LED effect {(2.7)/20}=0.135 can be obtained and a value 251 relative to the LED effect 0.056=100 can be further obtained.

The cyan light can be obtained by the combination of an LED emitting blue (B) light and a green (G) emitting phosphor. The magenta light can be obtained by the combination of an LED emitting blue (B) light and a red (R) emitting phosphor.

FIG. 7A also shows values including duty loss. The duty loss is a value obtained from the experimental result that an LED effect decreases about 10% when an LED is driven by the field-sequential system.

Therefore, the LED effect 100 becomes 90 and the LED effect 251 becomes 226 in consideration of the duty loss.

FIG. 7B is a comparative table of an aperture ratio, a transmittance and an LED effect of a conventional field sequence system and those of the present embodiment. In an RGB field-sequential system implemented by time division emission of R, G and B LEDs without filter, the aperture ratio is 78.8%, the transmittance is 25.3% and the LED effect is 90.

In contrast, in the first field-sequential system implemented by blue and yellow filters and cyan and magenta light from the backlight (in the case where an area ratio between B filter and Y filter is 1:2), the aperture ratio is B=57.8% and Y=67.8%, the transmittance is 13.3% and the LED effect is 226. In the second field-sequential system realized by blue and yellow filters and cyan and magenta light from the backlight (in the case where the area ratio between B filter and Y filter is 1:3), the aperture ratio is B=49.9% and Y=73.0%, the transmittance is 16.1% and the LED effect is 226.

On the assumption that the energy efficiency of the light device is obtained by multiplying a transmittance a by an LED effect b, the energy efficiency is as follows:

The RGB field-sequential system . . . 22.8

The first field-sequential system . . . 30.1

The second field-sequential system . . . 36.4

It is obvious from the above values that the present embodiment is superior in energy efficiency of the light device.

Figure 8A:
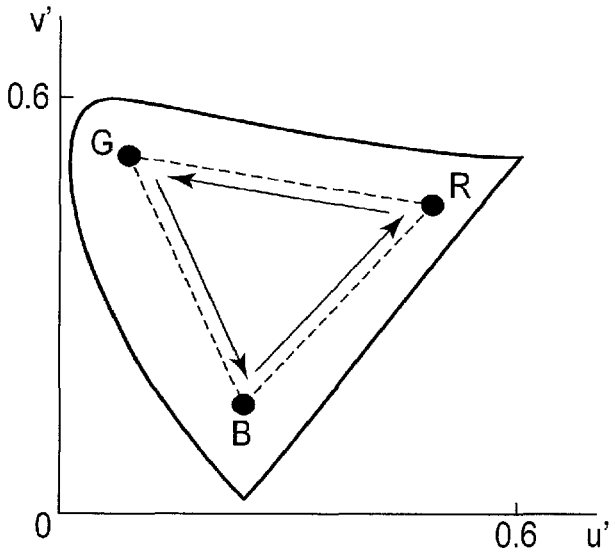
FIG. 8A is a diagram showing a distance of color change in the case where a display color is changed in an area including primary colors R, G and B in a chromaticity diagram.
Figure 8B:
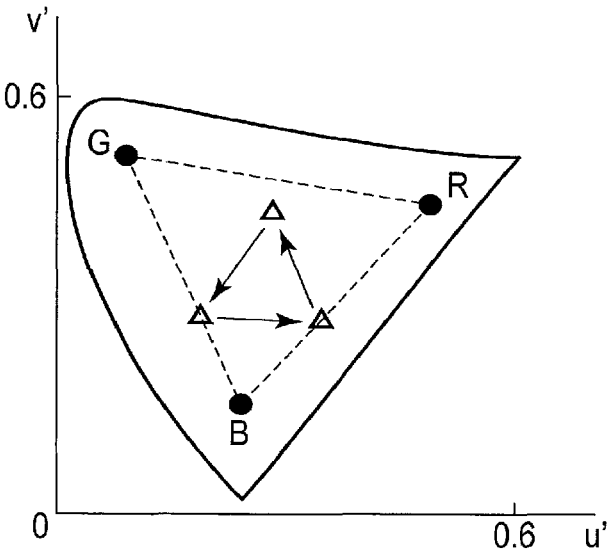
FIG. 8B is a diagram showing a distance of color change in the case where a display color is changed in an area of cyan and magenta in a chromaticity diagram.

In FIG. 8A, a distance of color change in a chromaticity diagram in the case where a display color is changed in an area including primary colors R, G and B is expressed by arrows. In FIG. 8B, a distance of color change in the chromaticity diagram in the case where the display color is changed in an area of cyan and magenta is expressed by arrows. Comparison between these diagrams has shown that the distance of color change in the case where the display color is changed in the area of cyan and magenta is shorter than that in the case where the display color is changed in the area including primary colors R, G and B. This means that a difference in chromaticity is small when the display color is changed. A color breakup (CBU) can be thereby reduced.

FIG. 9A is a timing chart showing operation of a light device of yet another embodiment which has a white (W) emission field in addition to cyan and magenta emission fields. The white (W) emission field can be obtained by turning on cyan and magenta phosphor LEDs at the same time. Therefore, white (W) light-emitting diodes shown in FIG. 4A are unnecessary. This lighting control is performed by a light device control circuit (it may be called a back light control circuit, not shown) in the driving IC chip CP (shown in FIG. 2) which drives the LCD.

Therefore, green, blue and an intermediate color between green and blue can be expressed in the cyan emission field, and red, blue and an intermediate color between red and blue can be expressed in the magenta emission field. In the white (W) emission field, red, green and blue (i.e., white [W]) can be expressed.

FIG. 9B shows yet another embodiment. In contrast to the embodiment of FIG. 9A in which yellow and blue filters are used as color filters, yellow, blue and white (W) filters are used as color filters in the embodiment of FIG. 9B. A process of lighting of the light device is the same as FIG. 9A. That is, the light device has a white (W) emission field in addition to cyan and magenta emission fields.

In the cyan emission field, blue, green and an intermediate color between blue and green can be expressed. In the magenta emission field, blue, red and an intermediate color between blue and red can be expressed. In the white (W) emission field, red, green and blue (i.e., white [W]) can be expressed.

Figure 10A:
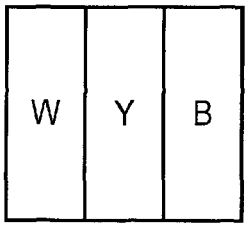
FIG. 10A is a diagram showing an embodiment in which filters include white (W), yellow (Y) and blue (B) filters.

FIG. 10A shows an embodiment in which filters include white (W), yellow (Y) and blue (B) filters. In this embodiment, the areas of the white (W), yellow (Y) and blue (B) filters are equal to each other. Subpixels correspond to the white (W), yellow (Y) and blue (B) filters, respectively. A set of the white (W), yellow (Y) and blue (B) filters and the corresponding subpixels is called a pixel (or unit pixel). Any colors in RGB can be expressed by pixels. Subpixels are provided to form pixels. The planar shape of each pixel (combined white (W), yellow (Y) and blue (B) filters) is, for example, square.

Figure 10B:
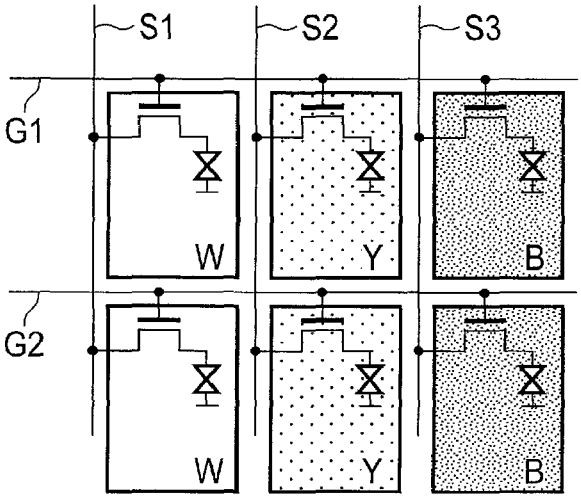
FIG. 10B is a diagram showing an example of pixel circuits corresponding to the filters of FIG. 10A.

FIG. 10B shows an example of pixel circuits corresponding to the filters of FIG. 10A. The pixel circuit of each subpixel has the structure illustrated in FIG. 2. That is, the pixel circuit of each subpixel comprises a switching element. The switching element comprises, for example, a thin-film transistor (TFT). A gate is connected to a gate line G, a source is connected to a signal line S and a drain is connected to a pixel electrode which drives the liquid crystal of the liquid crystal layer.

Figure 11A:
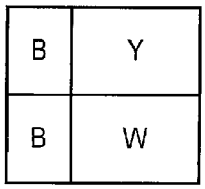
FIG. 11A is a diagram showing another embodiment in which filters include white (W), yellow (Y) and blue (B) filters.

FIG. 11A shows another embodiment in which filters include white (W), yellow (Y) and blue (B) filters. In this embodiment, the area of each of the yellow (Y) and white (W) filters is larger than the area of the blue (B) filter.

Figure 11B:
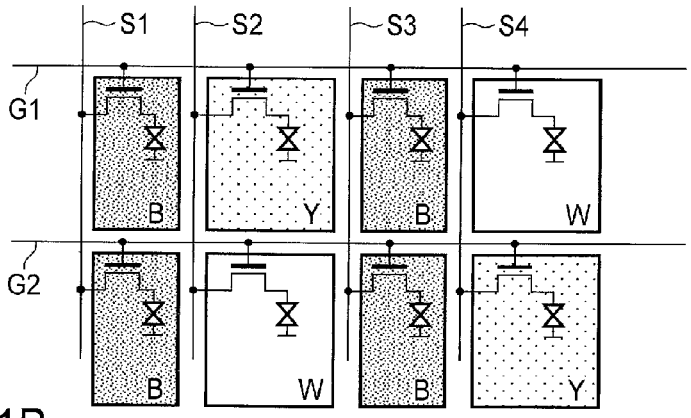
FIG. 11B is a diagram showing an example of pixel circuits corresponding to the filters of FIG. 11A.

FIG. 11B shows an example of pixel circuits corresponding to the filters of FIG. 11A. The pixel circuit of each subpixel has the structure illustrated in FIG. 2. Blue (B) subpixels are continuously arranged in the column direction (second direction Y). Yellow (Y) and white (W) subpixels are alternately arranged in the column direction (second direction Y). The yellow (Y) and white (W) subpixels are alternately arranged in the row direction (first direction X) with the blue (B) subpixels between. In this embodiment, too, the planar shape of each pixel (unit pixel) is square. In the structure of FIG. 11B, a blue (B) filter is assigned to each yellow (Y) filter and white (W) filter. In other words, a blue (B) filter is provided in each pixel in the structure of FIG. 11B.

Figure 11C:
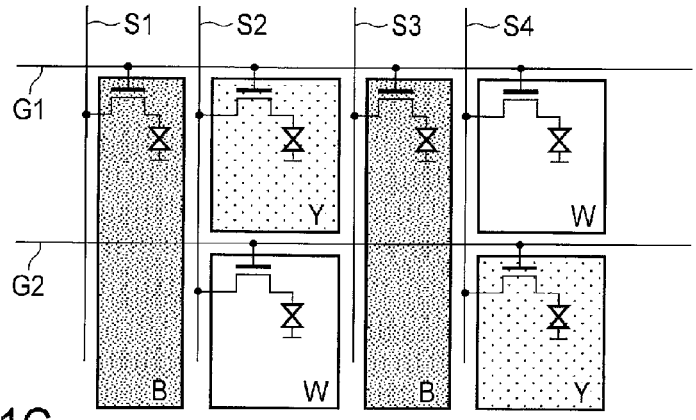
FIG. 11C is a diagram showing another example of pixel circuits corresponding to the filters of FIG. 11A.

FIG. 11C shows another example of pixel circuits corresponding to the filters of FIG. 11A. The pixel circuits of FIG. 11C are different from those of FIG. 11B in that a blue (B)

subpixel is provided over two rows. More specifically, a source and a gate of a switching element of a blue (B) subpixel are connected to gate line G1 and source line S1, respectively, and a pixel electrode and a blue (B) filter include the subpixel together with the switching element are extended from the first row to the second row. That is, each blue (B) filter is shared by a yellow (Y) filter and a white (W) filter. In other words, a blue (B) filter is provided over pixels in the structure of FIG. 11C.

Figure 12A:
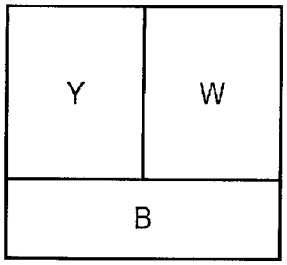
FIG. 12A is a diagram showing yet another embodiment in which filters include white (W), yellow (Y) and blue (B) filters.
Figure 12B:
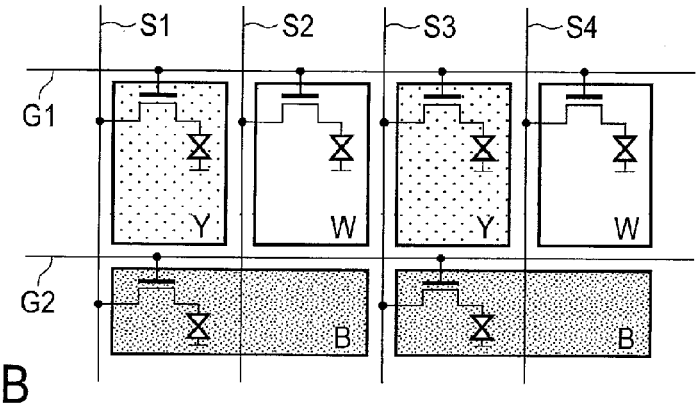
FIG. 12B is a diagram showing an example of pixel circuits corresponding to the filters of FIG. 12A.

FIG. 12A shows yet another embodiment in which filters include white (W), yellow (Y) and blue (B) filters. In this embodiment, yellow (Y) subpixels and white (W) subpixels are alternately arranged in the row direction (first direction X) in the first row. Blue (B) subpixels are arranged in the row direction (first direction X) in the second row. A blue (B) subpixel is equal in length to two subpixels, i.e., a white (W) subpixel and a yellow (Y) subpixel. For example, in FIG. 12B showing an example of pixel circuits corresponding to the filters of FIG. 12A, a source and a gate of a switching element of a blue (B) subpixel is connected to gate line G2 and source line S1, respectively, and a pixel electrode and a blue (B) filter include the subpixel together with the switching element are extended from the first column to the second column. In the present embodiment, too, the planar shape of each pixel (unit pixel) is square.

Figure 12C:
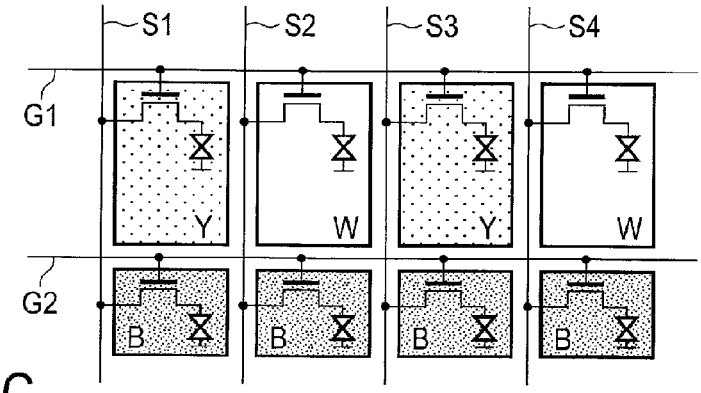
FIG. 12C is a diagram showing another example of pixel circuits corresponding to the filters of FIG. 12A.

FIG. 12C shows another example of pixel circuits corresponding to the filters of FIG. 12A. The pixel circuits of FIG. 12C and those of FIG. 12B are different from each other in that a blue (B) subpixel of FIG. 12B is provided over two columns but a blue (B) subpixel of FIG. 12C is provided in each column.

Figure 13:
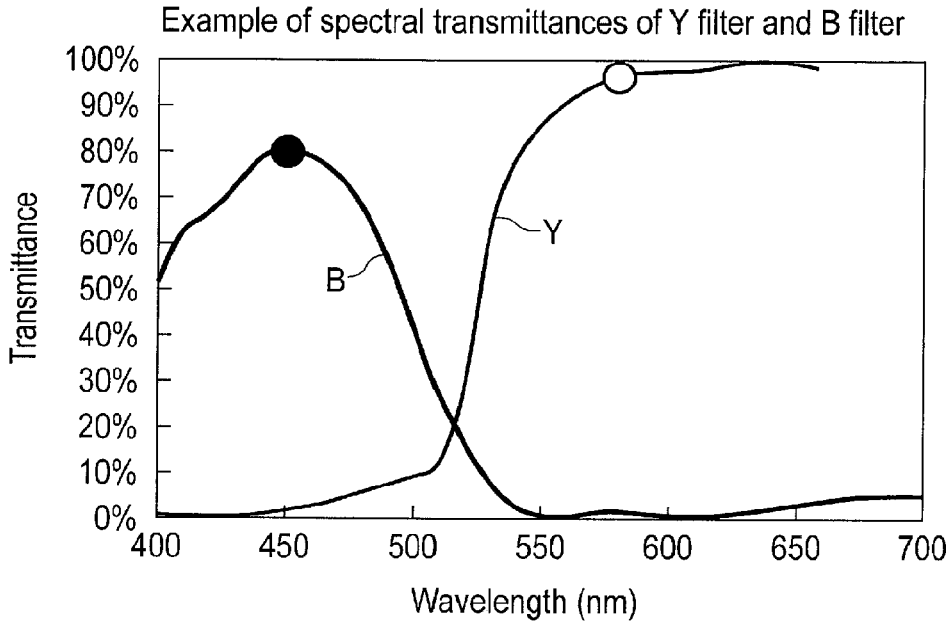
FIG. 13 is a graph showing an example of spectral transmittances of a blue (B) filter and a yellow (Y) filter.

FIG. 13 shows an example of spectral (or spectrum) transmittance curves of blue (B) and a yellow (Y) filters. Light with wavelengths around 450 nm easily passes through the blue (B) filter (for example, the transmittance is represented as Tb). Light with wavelengths around 580 nm easily passes through the yellow (Y) filter (for example, the transmittance is represented as Ty).

Figure 14:
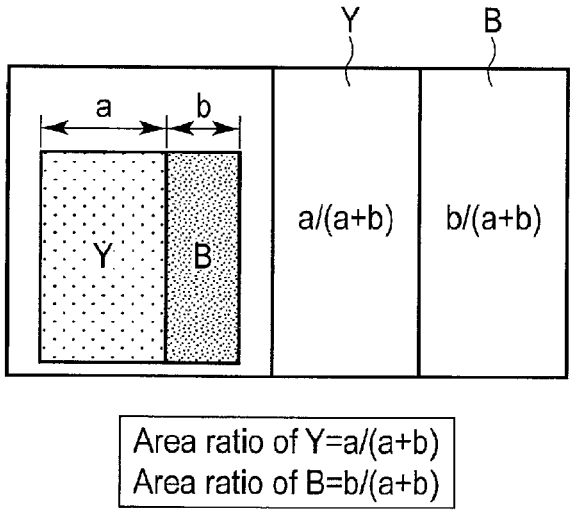
FIG. 14 is a diagram showing an example of calculation of area ratios of a blue (B) filter and a yellow (Y) filter.

FIG. 14 shows an example of calculation of area ratios of blue (B) and yellow (Y) filters to a pixel. On the assumption that the width of a yellow (Y) filter is a, the width of a blue (B) filter is b and these filters has the same length, the area ratio of the blue (B) filter is b/(a+b) and an area ratio of the yellow (Y) filter is a/(a+b).

Since the spectral transmittances Tb and Ty of the blue (B) and yellow (Y) filters are shown in the above graph, a transmittance ratio of color filters can be obtained from the spectral transmittances Tb and Ty and the area ratios b/(a+b) and a/(a+b) of the blue (B) and yellow (Y) filters.

For example, the transmittance ratio of the color filters can be expressed as $\{Tb\times b/(a+b)\}/\{Ty\times a/(a+b)\}$.

Figure 15:
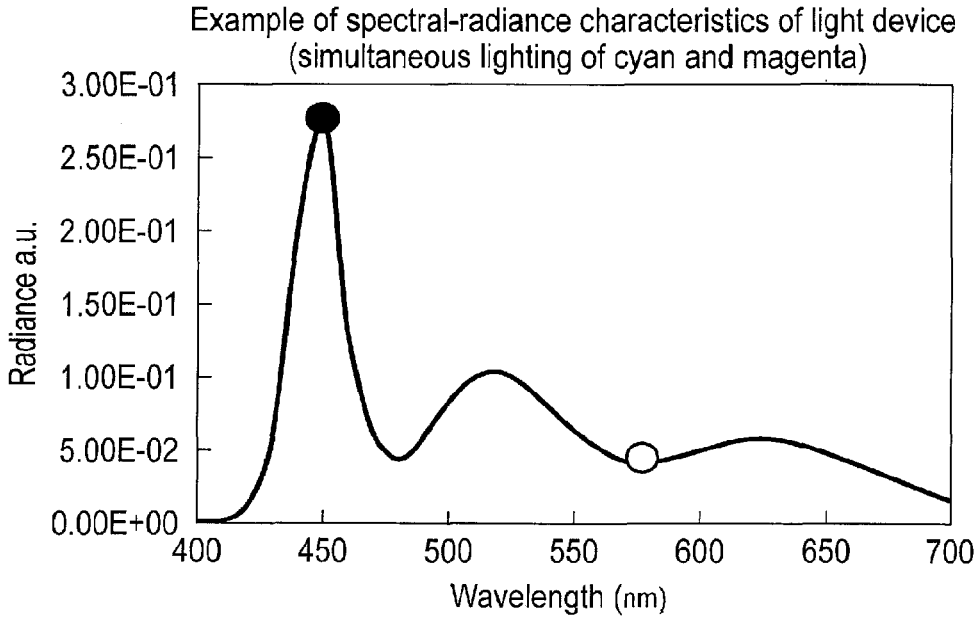
FIG. 15 is a graph showing an example of spectral-radiance characteristics in the case where a magenta LED and a cyan LED of the light device are turned on at the same time.

FIG. 15 shows an example of spectral-radiance (it may be called spectrum luminance) characteristics in the case where magenta and cyan LEDs of the light device are turned on at the same time. The spectral-radiance characteristics show that the energy of light with wavelengths around 450 and 580 nm is high. The energy of light with wavelengths around 450 nm is higher than the energy of light with wavelengths around 580 nm. A luminance ratio between magenta and cyan can be obtained from the characteristics. For example, the luminance ratio of the light device is expressed as (luminance at 450 nm/luminance at 580 nm).

Figure 16:
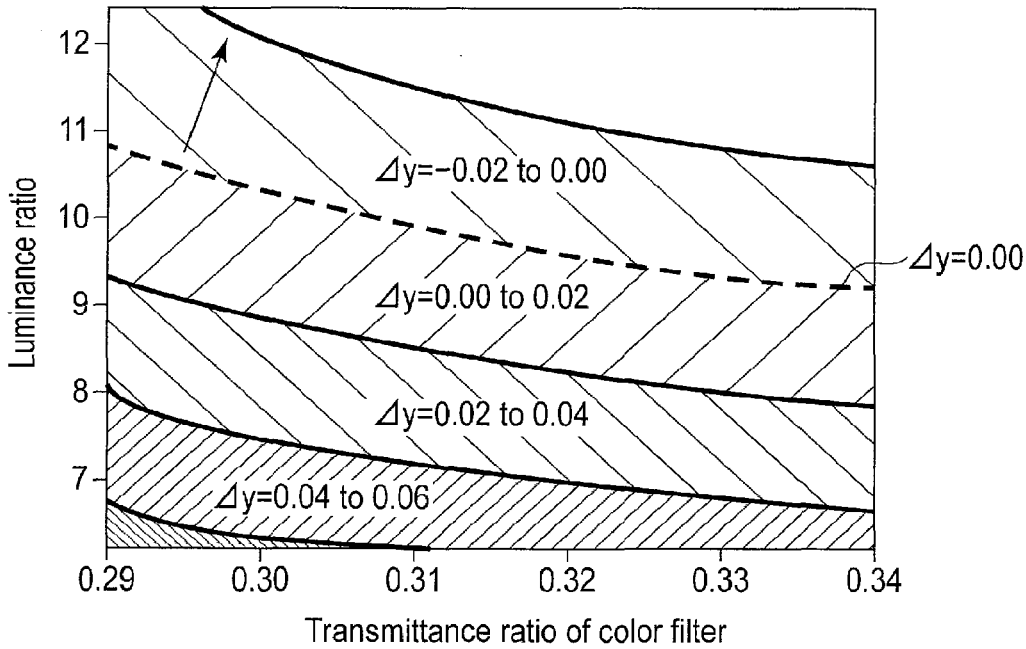
FIG. 16 is a graph showing a relationship between a transmittance ratio of blue and yellow filters and a luminance ratio of magenta and cyan of the light device by using the spectral transmittances of the two filters shown in FIG. 13, the area ratios of the two filters shown in FIG. 14 and the spectral radiance shown in FIG. 15.

FIG. 16 shows a relationship between the transmittance ratio $\{Tb\times b/(a+b)\}/\{Ty\times a/(a+b)\}$ of the color filters and the luminance ratio of the light device (luminance at 450 nm/luminance at 580 nm), based on a chromaticity deviation $\Delta y$ from a chromaticity point of white which is the standard of chromaticity.

In FIG. 16, the horizontal axis represents the transmittance ratio of the color filters and the vertical axis represents the luminance ratio of the light device. The luminance ratio of the light device is obtained by calculating (luminance at 450 nm/luminance at 580 nm) based on the spectral-radiance characteristics in the case where the magenta and cyan LEDs of the light device are turned on at the same time (FIG. 15).

The graph of FIG. 16 shows the following cases:

$\Delta y=-0.02$ or less $\Delta y=-0.02$ to 0.00

$\Delta y=0.00$ to 0.02

$\Delta y=0.02$ to 0.04

$\Delta y=0.04$ to 0.06

$\Delta y=0.06$ or more

A characteristic line of the deviation $\Delta y=0.00$ from the chromaticity point of white is shown by a thick dotted line. If the deviation $\Delta y$ is 0.00 or less, white, which is the standard of chromaticity, can be sufficiently obtained.

Therefore, if one of the luminance ratio of the light device and the transmittance ratio of the color filters is determined at the design phase, the other of them can be determined using the characteristics shown in the graph.

As described above, a relationship between a filter transmittance ratio obtained from area ratios of the blue and yellow filters and a luminance ratio of magenta and cyan light includes a characteristic to maintain a position of a white point in a chromaticity diagram. Therefore the relationship can be set to the characteristic to maintain a position of a white point in a chromaticity diagram.

For example, the characteristic line of the graph is expressed by $265-0.419\times$(transmittance ratio of color filter).

The deviation $\Delta y=-0.041\times$(luminance ratio of light device). If the deviation $\Delta y$ is 0.00 or less, $\Delta y\leq 0$.

According to the above-described embodiments, a display device and a display method capable of reducing the energy consumption as a whole without a large decrease in the efficiency of transmittance can be provided.

That is, since the display device of the embodiments has color filters, the energy efficiency of the light device (i.e., LED effect) is higher than that of a device of a field-sequential system without filters. Therefore, the display device of the embodiments is excellent in energy efficiency as a whole.

The following is an illustrative embodiment:

(1) A display device comprising: subpixels arranged in a first direction and a second direction intersecting the first direction; color filters corresponding to the subpixels, respectively; and a light device, wherein the color filters include at least blue filters and yellow filters adjacent to each other, the light device comprises a light source, and a frame period of the light source includes at least a period of outputting cyan light and a period of outputting magenta light.

(2) The display device according to (1), further comprising a subpixel comprising a white filter.

(3) The display device according to (1), wherein the frame period of the light source further includes a period of outputting white light.

(4) The display device of, wherein the frame period of the light source further includes a period of outputting white light, and the cyan light and the magenta light are simultaneously output in the period of outputting the white light.

(5) The display device of, wherein an area of each blue filter is smaller than an area of each yellow filter.

(6) The display device of (1), further comprising: a pixel comprising one of the blue filters and one of the yellow filters and having a substantially-square planar shape; or a pixel comprising one of the blue filters, one of the yellow filters and a white filter and having a substantially-square planar shape.

(7) The display device of (1), wherein the blue filters are arranged in the first direction, and the yellow filters and white filters are alternately arranged in the first direction.

(8) The display device of (1), wherein the blue filters are arranged in the second direction, and the yellow filters and white filters are alternately arranged in the second direction.

(9) The display device of (7), wherein one of the blue filters is assigned to one of yellow filters and one of white filters.

(10) The display device of (7), wherein one of the blue filters is assigned to each yellow filter and white filter.

(11) The display device of (8), wherein one of the blue filters is assigned to each yellow filter and white filter.

(12) The display device of (8), wherein each blue filter is shared by one of the yellow filters and one of the white filters.

(13) The display device according to (1), wherein the light device is controlled by a back light control circuit.

(14) The display device according to (1) wherein a relationship between a filter transmittance ratio obtained from area ratios of the blue and yellow filters and a luminance ratio of magenta and cyan light is a characteristic to maintain a position of a white point in a chromaticity diagram.

(15) A method of driving a display device comprising subpixels arranged in a first direction and a second direction intersecting the first direction, color filters corresponding to the subpixels, respectively, and a light device, wherein the color filters include at least blue filters and yellow filters adjacent to each other, and the light device outputs at least cyan light and magenta light in a frame period.

(16) The method of (15), wherein the light device outputs white light in the frame period.

(17) The method of (15), wherein the light device outputs white light in the frame period, and simultaneously outputs the cyan light and the magenta light in a field of outputting white light.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

subpixels arranged in a first direction and a second direction intersecting the first direction;

color filters corresponding to the subpixels, respectively; and a light device, wherein the color filters include at least blue filters and yellow filters adjacent to each other, an area of each blue filter is smaller than an area of each yellow filter, a ratio between the area of each blue filter and the area of each yellow filter is one of 1:2 or 1:3, the light device comprises a cyan light source and a magenta light source only, and a frame period of the light device includes a period of outputting cyan light and a period of outputting magenta light.

2. The display device according to claim 1, further comprising a subpixel comprising a white filter.

3. The display device according to claim 1, wherein the frame period of the light device further includes a period of outputting white light.

4. The display device according to claim 1, wherein the frame period of the light device further includes a period of outputting white light, and the cyan light and the magenta light are simultaneously output in the period of outputting the white light.

5. The display device according to claim 1, further comprising:

a pixel comprising one of the blue filters and one of the yellow filters and having a substantially-square planar shape; or a pixel comprising one of the blue filters, one of the yellow filters and a white filter and having a substantially-square planar shape.

6. The display device according to claim 1, wherein the blue filters are arranged in the first direction, and the yellow filters and white filters are alternately arranged in the first direction.

7. The display device according to claim 6, wherein one of the blue filters is assigned to each yellow filter and white filter.

8. The display device according to claim 1, wherein the blue filters are arranged in the second direction, and the yellow filters and white filters are alternately arranged in the second direction.

9. The display device according to claim 8, wherein each blue filter is shared by one of the yellow filters and one of the white filters.

10. The display device according to claim 8, wherein one of the blue filters is assigned to each yellow filter and white filter.

11. The display device according to claim 6, wherein each blue filter is shared by one of the yellow filters and one of the white filters.

12. The display device according to claim 1, wherein, wherein the light device is controlled by a back light control circuit.

13. The display device according to claim 1, wherein a relationship between a filter transmittance ratio obtained from area ratios of the blue and yellow filters and a luminance ratio of magenta and cyan light is a characteristic to maintain a position of a white point in a chromaticity diagram.

14. A method of driving a display device comprising subpixels arranged in a first direction and a second direction intersecting the first direction, color filters corresponding to the subpixels, respectively, and a light device, wherein the color filters include blue filters and yellow filters adjacent to each other, an area of each blue filter is smaller than an area of each yellow filter, a ratio between the area of each blue filter and the area of each yellow filter is one of 1:2 or 1:3, and the light device outputs cyan light and magenta light only in a frame period.

15. The method according to claim 14, wherein the light device outputs white light in a part of the frame period by simultaneously driving the cyan light source and the magenta light source.

16. The method according to claim 14, wherein the light device outputs white light in the frame period, and simultaneously outputs the cyan light and the magenta light in a field of outputting white light.

* * * * *